US012005333B2

(12) United States Patent
Escamilla

(10) Patent No.: US 12,005,333 B2
(45) Date of Patent: Jun. 11, 2024

(54) BODY SUSPENSION EXERCISE DEVICE

(71) Applicant: Eric Escamilla, Cypress, TX (US)

(72) Inventor: Eric Escamilla, Cypress, TX (US)

( * ) Notice: Subject to any disclaimer, the term of this patent is extended or adjusted under 35 U.S.C. 154(b) by 65 days.

(21) Appl. No.: 17/684,788

(22) Filed: Mar. 2, 2022

(65) Prior Publication Data

US 2022/0288478 A1 Sep. 15, 2022

Related U.S. Application Data

(60) Provisional application No. 63/159,120, filed on Mar. 10, 2021.

(51) Int. Cl.
*A63B 69/00* (2006.01)
*A63B 23/02* (2006.01)

(52) U.S. Cl.
CPC ..... *A63B 69/0062* (2020.08); *A63B 23/0211* (2013.01)

(58) Field of Classification Search
CPC ..... A63B 21/00047; A63B 21/00054; A63B 21/00178; A63B 21/00181; A63B 21/40; A63B 21/4011; A63B 21/4025; A63B 69/22; A63B 69/222; A63B 69/0057; A63B 69/0062; A61H 1/0218; A61H 1/0229; A61H 1/0237
See application file for complete search history.

(56) References Cited

U.S. PATENT DOCUMENTS

| | | | | |
|---|---|---|---|---|
| 3,988,020 | A * | 10/1976 | Carter | A63B 69/12 482/55 |
| 5,209,712 | A * | 5/1993 | Ferri | A61H 1/02 482/131 |
| 5,403,253 | A * | 4/1995 | Gaylord | A63B 69/0064 482/142 |
| 5,868,652 | A * | 2/1999 | Spletzer | A63B 21/065 2/22 |
| 6,368,296 | B1 * | 4/2002 | Eiter | A63B 21/4009 482/146 |
| 6,551,196 | B1 * | 4/2003 | Kossnar | A63B 69/3608 473/277 |
| 9,259,605 | B1 * | 2/2016 | Puig | A63B 23/1236 |
| 9,555,283 | B2 * | 1/2017 | Jolly | A63B 23/025 |
| 10,105,275 | B2 * | 10/2018 | Zbinden | A63B 21/4015 |
| 10,486,008 | B2 * | 11/2019 | Prihar | A63B 21/00065 |
| 10,898,750 | B1 * | 1/2021 | Angulo | A63B 21/0552 |
| 11,406,524 | B2 * | 8/2022 | Ponsi | A61G 7/0755 |
| 2004/0035638 | A1 * | 2/2004 | Boyd | A63B 71/1225 182/134 |

(Continued)

*Primary Examiner* — Zachary T Moore
(74) *Attorney, Agent, or Firm* — Brennan, Manna & Diamond, LLC

(57) ABSTRACT

The present invention relates to a body suspension exercise device primarily comprised of at least one pad, at least one strap, at least one ring with at least one mounting bracket and at least one clip, and at least one rope. In the preferred embodiment, the device has a plurality of pads attached to one another in a radial fashion, wherein the ring encloses the pads. A user can insert their legs into the pads, wherein the pads can then be tightened by the strap. The ring further receives a rope that allows the device to be suspended from an object or structure. Therefore, a user can suspend their legs using the device and perform a plurality of core, abdominal, and upper body exercises.

17 Claims, 3 Drawing Sheets

(56) References Cited

U.S. PATENT DOCUMENTS

| | | | | |
|---|---|---|---|---|
| 2016/0228319 | A1* | 8/2016 | Whitley | A45F 3/26 |
| 2017/0007491 | A1* | 1/2017 | Crombie | A63B 21/4033 |
| 2017/0189758 | A1* | 7/2017 | Angulo | A61F 5/30 |
| 2018/0236336 | A1* | 8/2018 | Rodriguez | G09B 19/0038 |
| 2021/0387688 | A1* | 12/2021 | Seguin | B62J 7/04 |
| 2022/0370276 | A1* | 11/2022 | Ponsi | A61F 5/34 |

* cited by examiner

BODY SUSPENSION EXERCISE DEVICE

CROSS-REFERENCE TO RELATED APPLICATION

The present application claims priority to, and the benefit of, U.S. Provisional Application No. 63/159,120, which was filed on Mar. 10, 2021, and is incorporated herein by reference in its entirety.

FIELD OF THE INVENTION

The present invention relates generally to the field of exercise devices. More specifically, the present invention relates to a body suspension exercise device primarily comprised of at least one pad, at least one strap, at least one ring with at least one mounting bracket and at least one clip, and at least one rope. In the preferred embodiment, the device has a plurality of pads attached to one another in a radial fashion, wherein the ring encloses the pads. A user can insert their legs into the pads, wherein the pads can then be tightened by the strap. The ring further receives a rope that allows the device to be suspended from an object or structure. Therefore, a user can suspend their legs using the device and perform a plurality of core, abdominal, and upper body exercises. Accordingly, the present disclosure makes specific reference thereto. Nonetheless, it is to be appreciated that aspects of the present invention are also equally applicable to other like applications, devices and methods of manufacture.

BACKGROUND

Many individuals exercise regularly to build a healthy body and mind. Further, individuals may specifically desire to build strong core, abdominal, and upper body muscles. However, core, abdominal, and upper body exercises that can be performed without exercise equipment are limited. In addition, said exercise equipment is typically expensive, large, and bulky. This is undesirable for individuals who desire to better build their core, abdominal, and upper body muscles without using exercise equipment, but who also may not have the physical space or money to purchase specific core, abdominal, and upper body-related exercise equipment.

Therefore, there exists a long-felt need in the art for an exercise device that allows a user to exercise their core, abdominal, and upper body muscles. There also exists a long-felt need in the art for a body suspension exercise device that offers a user additional exercises, ranges of motion, and positions to work their core, abdominal, and upper body muscles than existing body-only exercises. Further, there exists a long-felt need in the art for a body suspension exercise device that offers a user additional exercises, ranges of motion, and positions to work their core, abdominal, and upper body muscles than existing body-only exercises, while using a device that takes up minimal space, portable, and that is low in cost to manufacture.

The subject matter disclosed and claimed herein, in one embodiment thereof, comprises a body suspension exercise device. The device is primarily comprised of at least one pad, at least one strap, at least one ring with at least one mounting bracket and at least one clip, and at least one rope. In the preferred embodiment, the device has a plurality of pads attached to one another in a radial fashion, wherein the ring encloses the pads. A user can insert their legs into the pads, wherein the pads can then be tightened by the strap.

The ring further receives a rope that allows the device to be suspended from an object or structure. Therefore, a user can suspend their legs using the device and perform a plurality of core, abdominal, and upper body exercises.

In this manner, the body suspension exercise device of the present invention accomplishes all of the forgoing objectives and provides a device that allows a user to exercise their core, abdominal, and upper body muscles using additional exercises, ranges of motion, and positions than existing body-only exercises. In addition, the device takes up minimal space, is portable, and is low in cost to manufacture. As a result, the body suspension exercise device overcomes the limitations of existing methods of bodyweight exercises and exercise equipment known in the art.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a body suspension exercise device. The device is primarily comprised of at least one pad, at least one strap, at least one ring with at least one mounting bracket and at least one clip, and at least one rope. The pad is preferably manufactured from a cushioned, padded material. In the preferred embodiment, the device has a plurality of pads arranged in a circular (i.e., radial) fashion such that the pads have a central continuous opening at the first end. The outer surface of the pads is further comprised of at least one loop such that at least one strap can be fed through the loops around the second end. In this manner, the pads can be tightened around the legs of the user.

The pads are further surrounded by a ring that provides structural support to the device. The bottom surface of the ring contacts the outer surface of the pads. The top surface of the ring is further comprised of at least one mounting bracket that is fixedly or removably attached to the ring. The bracket further receives at least one clip. The clip further attaches to at least one rope which can be used to suspend the device from a structure such as, but not limited to: a ceiling, a wall, an object, etc. In this manner, the device can freely hang above a ground surface. The rope may have at least one integrated fastener that allows for attachment to said structures.

To use the device, the user first suspends the device from said structure as mentioned above. Then, the user places one or both legs through the second end of the opening such that the leg(s) contact the inner surface of the pads and the user's feet extend outwards from the first end of the opening. The user can then tighten the strap as needed around their legs using the fastener. Once their legs have been suspended above the ground surface, the user can then use their upper body to perform a plurality of core, abdominal, and upper body exercises.

Accordingly, the body suspension exercise device of the present invention is particularly advantageous as it allows a user to exercise their core, abdominal, and upper body muscles using additional exercises, ranges of motion, and positions than existing body-only exercises. While doing so, the device takes up minimal space, is portable, and is low in cost to manufacture. In this manner, the body suspension exercise device overcomes the limitations of existing methods of bodyweight exercises and exercise equipment known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
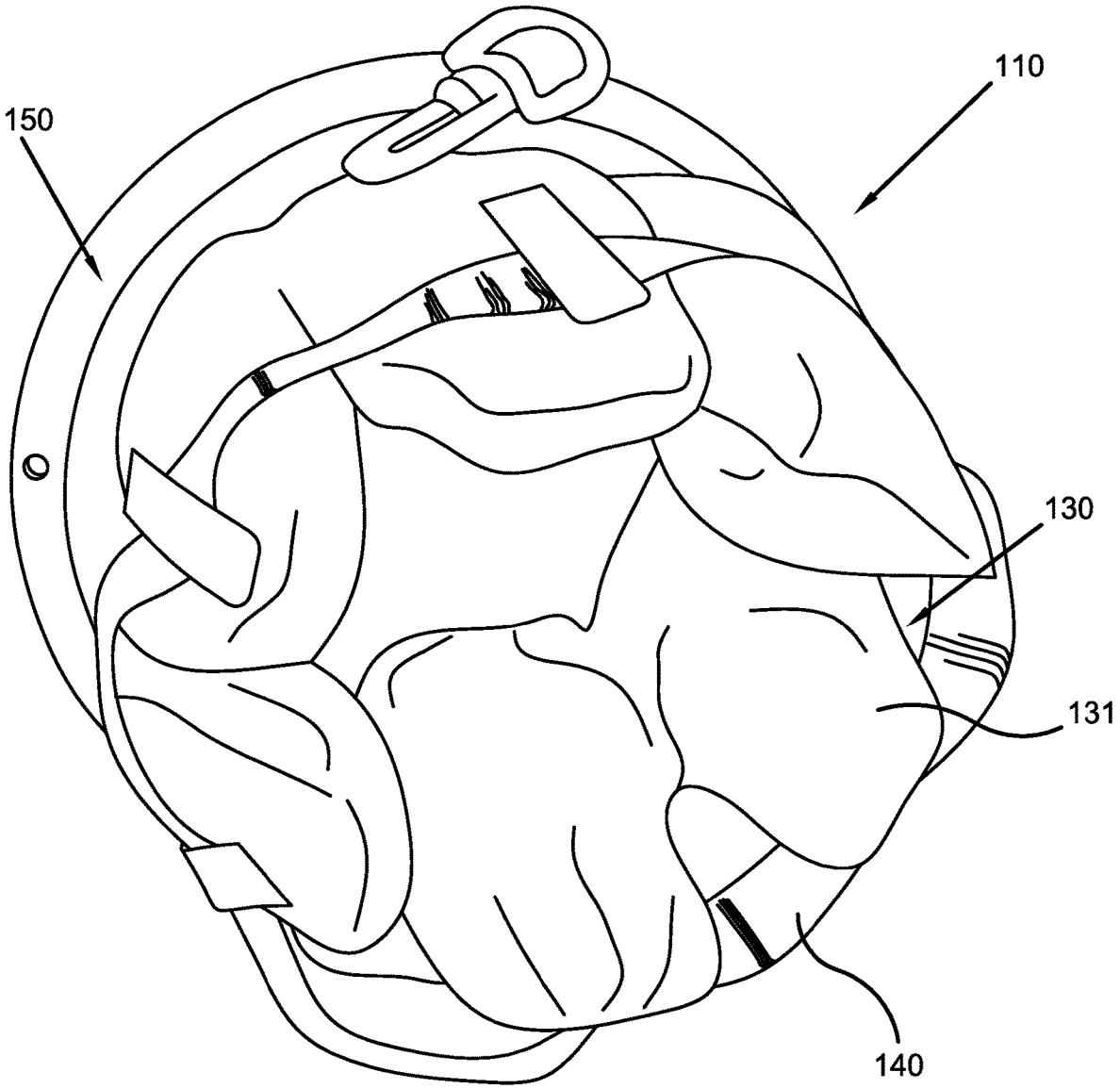
FIG. 1 illustrates a front perspective view of one potential embodiment of a body suspension exercise device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an exercise device that allows a user to exercise their core, abdominal, and upper body muscles. There also exists a long-felt need in the art for a body suspension exercise device that offers a user additional exercises, ranges of motion, and positions to work their core, abdominal, and upper body muscles than existing body-only exercises. Further, there exists a long-felt need in the art for a body suspension exercise device that offers a user additional exercises, ranges of motion, and positions to work their core, abdominal, and upper body muscles than existing body-only exercises, while using a device that takes up minimal space, portable, and that is low in cost to manufacture.

The present invention, in one exemplary embodiment, is comprised of a body suspension exercise device primarily comprised of at least one pad, at least one strap, at least one ring with at least one mounting bracket and at least one clip, and at least one rope. The pad is preferably manufactured from a cushioned, padded material. In the preferred embodiment, the device has a plurality of pads arranged in a circular (i.e., radial) fashion. The pads have a central continuous opening at the first end. The outer surface of the pads is further comprised of at least one loop. At least one strap can be fed through the loops around the second end. As a result, the pads can be tightened around the legs of the user.

The pads are further surrounded by a ring that provides structural support to the device. The bottom surface of the ring contacts the outer surface of the pads. The top surface of the ring is further comprised of at least one mounting bracket that is fixedly or removably attached to the ring. The bracket further receives at least one clip. The clip further attaches to at least one rope which can be used to suspend the device from a structure such as, but not limited to: a ceiling, a wall, an object, etc. In doing so, the device can freely hang above a ground surface. The rope may have at least one integrated fastener that allows for attachment to said structures.

To use the device, the user first suspends the device from said structure as mentioned. Then, the user places one or both legs through the second end of the opening such that the leg(s) contact the inner surface of the pads and the user's feet extend outwards from the first end of the opening. The user can then tighten the strap as needed around their legs using the fastener. Once their legs have been suspended above the ground surface, the user can then use their upper body to perform a plurality of core, abdominal, and upper body exercises.

Accordingly, the body suspension exercise device of the present invention is particularly advantageous as it allows a user to exercise their core, abdominal, and upper body muscles using additional exercises, ranges of motion, and positions than existing body-only exercises. While doing so, the device takes up minimal space, is portable, and is low in cost to manufacture. In this manner, the body suspension exercise device overcomes the limitations of existing methods of bodyweight exercises and exercise equipment known in the art.

Referring initially to the drawings, FIG. 1 illustrates a front perspective view of one potential embodiment of a body suspension exercise device 100 of the present invention in accordance with the disclosed architecture. The device 100 is primarily comprised of at least one pad 130, at least one strap 140, at least one ring 150 with at least one mounting bracket 156 and at least one clip 162, and at least one rope 160. Any portion of the device 100 may have indicia 180 in the form of patterns, logos, emblems, images, symbols, designs, letters, numbers, words, characters, animals, advertisements, brands, etc. The pad 130 is preferably manufactured from a cushioned, padded material such as, but not limited to: foam, natural down, synthetic down, etc. that may further have a waterproof or water-resistant (i.e., sweatproof) outer surface 132. The outer surface 132 may be manufactured from a fabric material such as, but not limited to: vinyl, canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, etc. In the preferred embodiment, the device 100 has a plurality of pads 130 arranged in a circular (i.e., radial) fashion such that the pads 130 have a central continuous opening 120 with a first end 122. In said embodiment, each pad 130 is further fixedly attached to one another in an inseparable fashion.

Figure 2:
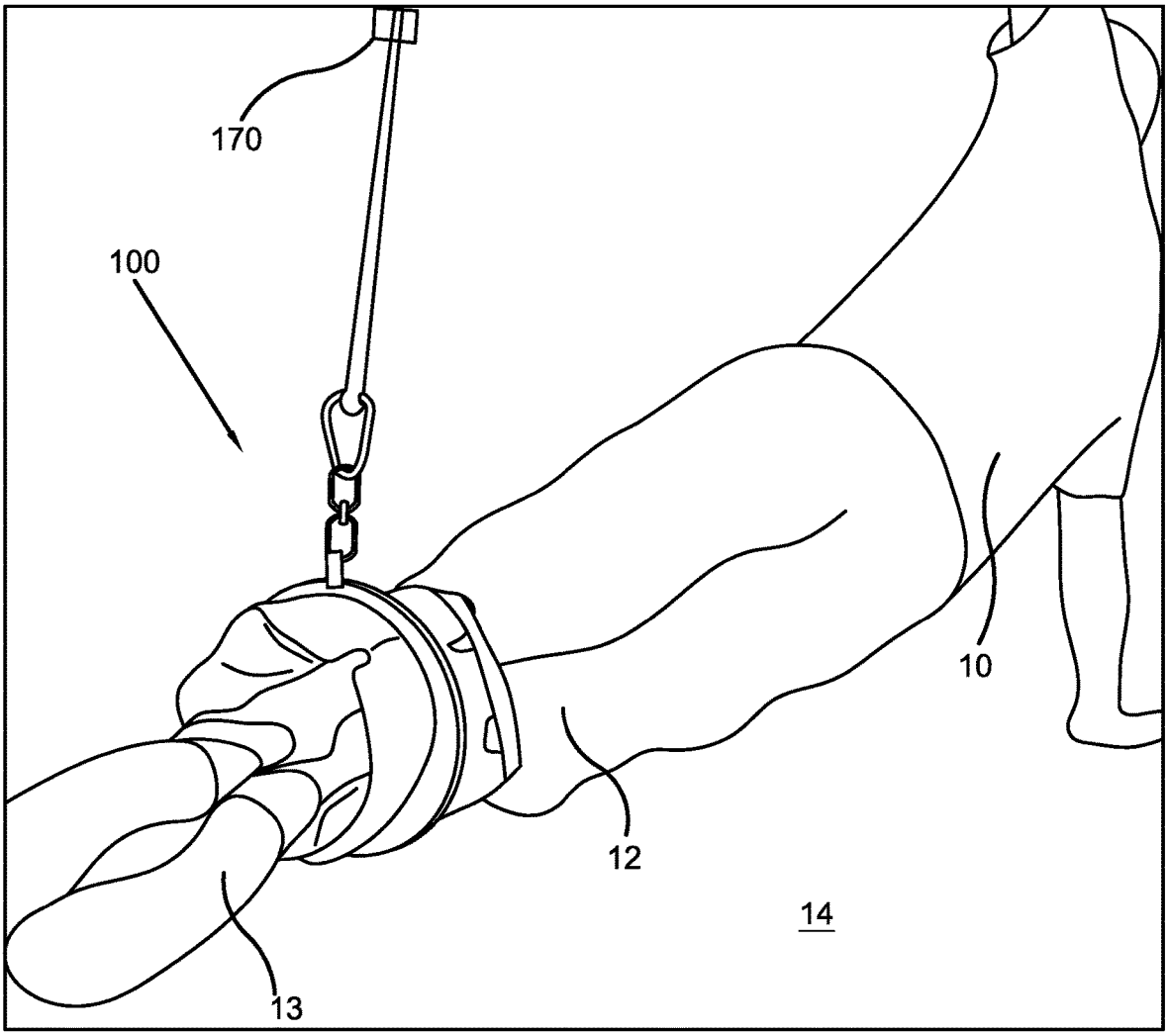
FIG. 2 illustrates a perspective view of one potential embodiment of a body suspension exercise device of the present invention while being used by a user in accordance with the disclosed architecture.
Figure 3:
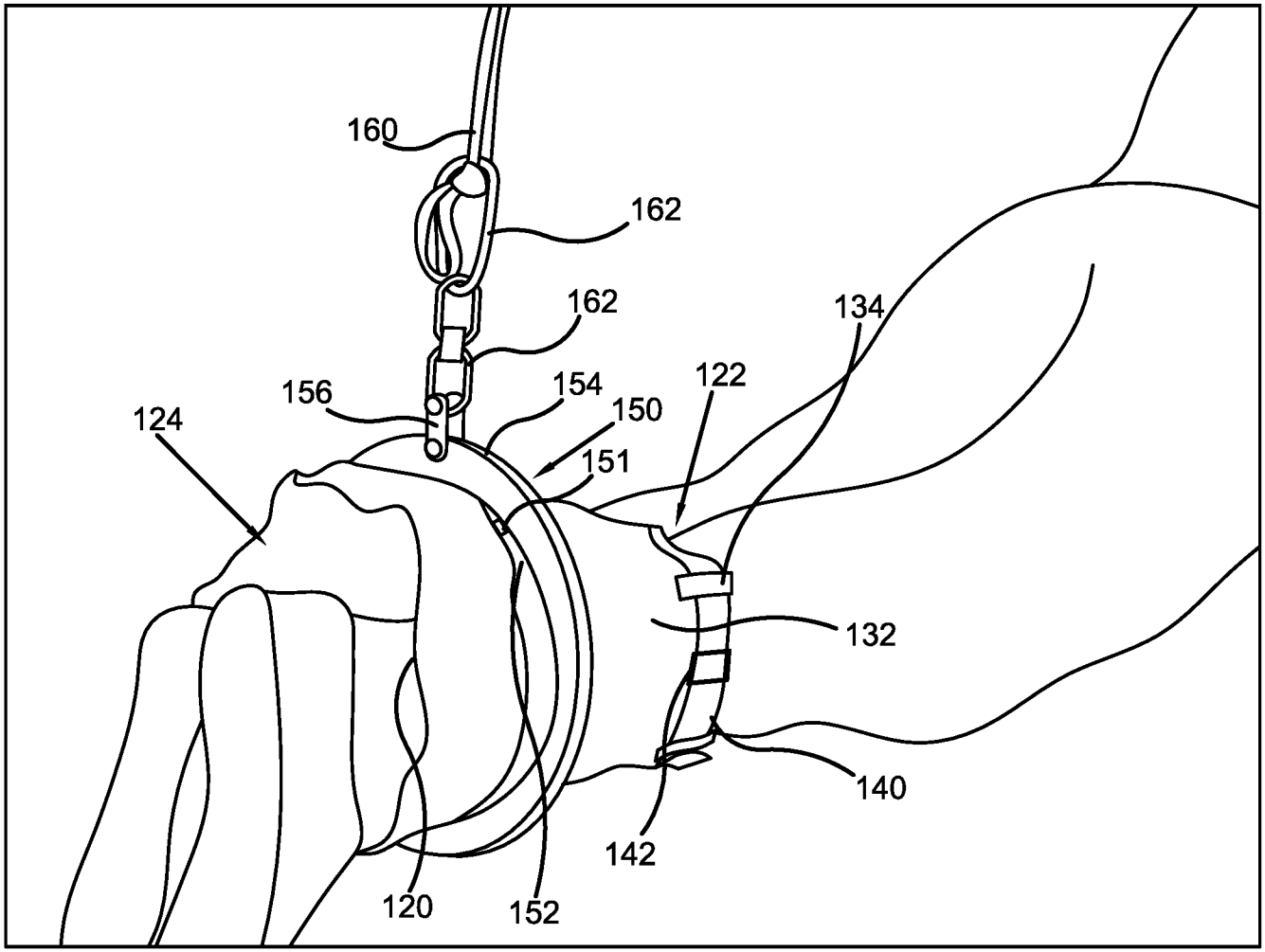
FIG. 3 illustrates a perspective view of one potential embodiment of a body suspension exercise device of the present invention while being used by a user in accordance with the disclosed architecture.

As best seen in FIG. 2 and FIG. 3, The outer surface 132 of the pads 130 is further comprised of at least one loop 134. In the preferred embodiment, each pad 130 has a loop 134 such that at least one strap 140 can be fed through the loops 134 around the second end 124. In this manner, the pads 130 can be tightened around the legs 12 of the user 10, as will be explained more fully below. The strap 140 may be manufactured from a fabric material such as, but not limited to: vinyl, canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, etc. The strap 140 further has at least one fastener 142 that may allow the strap 140 to increase/decrease in length in order to tighten the pads 130 around the legs 12 of the user 10. In differing embodiments, the fastener 142 may be fasteners such as, but not limited to: buckle, hook and loop, snap button, magnet, adhesive, ties, or other similar fasteners of the like.

The pads 130 are further surrounded by a ring 150 that provides structural support to the device 100. In differing embodiments, the ring 150 may be manufactured from a durable metal such as, but not limited to: stainless steel or aluminum, or a rigid plastic such as, but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, etc. The bottom surface 152 of the ring 150 contacts the outer surface 132 of the pads 130. In differing embodiments, the pads 130 may be fixedly attached or removably attached (i.e., to allow for cleaning of the pads 130) to the ring 150 via at least one fastener 151 such as, but not limited to: hook and loop, buckle, snap button, magnet, adhesive, ties, or other similar fastener of the like. The top surface 154 of the ring 150 is further comprised of at least one mounting bracket 156 that is fixedly or removably attached to the ring 150. The bracket 156 further receives at least one clip 162. In differing embodiments, the clip 162 may be any removable or fixedly attached clip 162 such as, but not limited to: swivel-eye snap hook, fixed-eye snap hook, slide-bolt spring-snap clip, spring-snap carabiners, etc.

In one embodiment, the ring 150 may have a first half 1500 and a second half 1501 positioned below the first half 1500. The first half 1500 of the ring 150 attaches to the mounting bracket 156 and is immovable. At least one rotatable bearing 1502 is positioned between the first half 1500 and second half 1501 such that the second half 1501 can rotate 360 degrees relative to the first half 1500. In said embodiment, the pads 130 are further secured to the second half 1501 as noted above. In this manner, the second half 1501 allows the pads 130 to rotate 360 degrees while the first half 1500 of the ring 150 remains stationary. As a result, a user 10 can twist and turn while using the device 100 without the entire device 100 rotating, which would inhibit the suspension of the device 100 as the rope 160 would no longer remain taunt.

The clip 162 further attaches to at least one rope 160 which can be used to suspend the device 100 from a structure such as, but not limited to: a ceiling, a wall, an object, etc. In this manner, the device 100 can freely hang above a ground surface 14. The rope 160 may have at least one integrated fastener 170 such as, but not limited to: an anchor, a screw, a bolt, a magnet, etc. that allows for attachment to said structures.

To use the device 100, the user 10 first suspends the device 100 from said structure as mentioned, supra. Then, the user 10 places one or both legs 12, through the second end 124 of the opening 120 such that the leg(s) 12 contacts the inner surface 131 of the pads 130 and the user's 10 feet extend outwards from the first end 122 of the opening 120. The user 10 can then tighten the strap 140 as needed around their legs 12 using the fastener 142. Once their legs 12 have been suspended above the ground surface 14, the user 10 can then use their upper body to perform a plurality of core, abdominal, and upper body exercises.

It should be noted that the device 100 allows a user to use their bodyweight to exercise, while substantially reducing or eliminating the actual amount of bodyweight felt by the muscles of the user 10 due to the suspension of the user's 10 legs 12 from the device 100. In addition, the device 100 is low-cost, is portable, and has an extremely small spatial footprint.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "body suspension exercise device" and "device" are interchangeable and refer to the body suspension exercise device 100 of the present invention.

Notwithstanding the forgoing, the body suspension exercise device 100 of the present invention and its various components can be of any suitable size and configuration as is known in the art without affecting the overall concept of the invention, provided that they accomplish the above-stated objectives. One of ordinary skill in the art will appreciate that the size, configuration and material of the body suspension exercise device 100 as shown in the FIGS. are for illustrative purposes only, and that many other sizes and shapes of the body suspension exercise device 100 are well within the scope of the present disclosure. Although the dimensions of the body suspension exercise device 100 are important design parameters for user convenience, the body suspension exercise device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A body suspension exercise device comprising:

a plurality of pads arranged in a circular fashion such that the plurality of pads form an opening, wherein each of the plurality of pads comprising a loop;

a strap;

a ring having a mounting bracket and a clip; and a rope; wherein the plurality of pads are enclosed by and attached to a bottom surface of the rings; and wherein the plurality of pads are inseparably attached to each other.

2. The body suspension exercise device of claim 1, wherein the ring surrounds each of the plurality of pads.

3. The body suspension exercise device of claim 1, wherein the strap surrounds each of the plurality of pads.

4. The body suspension exercise device of claim 1, wherein the rope attaches to the mounting bracket via the clip.

5. A body suspension exercise device comprising:

a plurality of pads arranged in a circular fashion to form an opening, wherein each of the plurality of pads is comprised of a loop;

a strap received by the loop of each of the plurality of pads; and a ring comprising a mounting bracket and a clip; and wherein the plurality of pads are enclosed by and attached to a bottom surface of the ring; and wherein the plurality of pads are comprised of a waterproof material or a water-resistant material; and wherein the plurality of pads are inseparably attached to each other.

6. The body suspension exercise device of claim 5 further comprised of a rope that attaches to the ring.

7. A body suspension exercise device comprising:

a plurality of pads arranged in a circular fashion such that the plurality of pads form an opening, each of the plurality of pads further comprised of a loop;

a strap received by the loop of each of the plurality of pads, wherein the strap is further comprising a fastener;

a ring further comprising a ring fastener, a mounting bracket and a clip; wherein the plurality of pads are enclosed by and attached to a bottom surface of the rings;

a rope further comprising a rope fastener; and wherein the plurality of pads are inseparably attached to each other.

8. The body suspension exercise device of claim 7, wherein the fastener of the strap allows the strap to tighten around the plurality of pads.

9. The body suspension exercise device of claim 8, wherein the fastener of the strap is a select one of: a buckle, a hook and loop fastener, a snap button, a magnet, an adhesive, and a tie fastener.

10. The body suspension exercise device of claim 7, wherein the plurality of pads are enclosed by and attached to the bottom surface of the ring via the fastener of the ring.

11. The body suspension exercise device of claim 10, wherein the plurality of pads are removably attachable from the bottom surface of the ring.

12. The body suspension exercise device of claim 11, wherein the plurality of pads are manufactured from a cushioned foam material.

13. The body suspension exercise device of claim 7, wherein the fastener of the ring is a select one of: a hook and loop fastener, a buckle, a snap button, a magnet, an adhesive, and a tie fastener.

14. The body suspension exercise device of claim 7, wherein the mounting bracket is located on a top surface of the ring.

15. The body suspension exercise device of claim 7, wherein the clip is a select one of: a swivel-eye snap hook, a fixed-eye snap hook, a slide-bolt spring-snap clip, and a spring-snap carabiner.

16. The body suspension exercise device of claim 7, wherein the fastener of the rope is a select one of: an anchor, a screw, a bolt, and a magnet.

17. The body suspension exercise device of claim 7, wherein each loop is located on an outer surface of the respective pad of the plurality of pads.

* * * * *